United States Patent [19]

Nakamori

[11] 3,938,278

[45] Feb. 17, 1976

[54] STARTER DEVICE FOR TOYS

[75] Inventor: Yasuo Nakamori, Matsudo, Japan

[73] Assignee: Sanyo Onkyo Seiki Co. Ltd., Tokyo, Japan

[22] Filed: Dec. 20, 1974

[21] Appl. No.: 534,705

[30] Foreign Application Priority Data

Aug. 29, 1974 Japan ..... 49-103530

[52] U.S. Cl. ..... 46/202; 46/208

[51] Int. Cl.[2] ..... A63H 17/00

[58] Field of Search ..... 46/202, 206, 208, 243 LV

[56] References Cited

UNITED STATES PATENTS

| | | | |
|---|---|---|---|
| 2,055,846 | 9/1936 | Marx | 46/206 |
| 3,169,345 | 2/1965 | Marmo et al. | 46/243 LV |
| 3,359,680 | 12/1967 | Lindsay | 46/206 |

*Primary Examiner*—Louis G. Mancene
*Assistant Examiner*—Robert F. Cutting
*Attorney, Agent, or Firm*—Hans Berman

[57] ABSTRACT

A starter device for a toy equipped with a drive and having an extra structure on which an accessory or auxiliary toy can be detachably mounted. Said device comprises operating members disposed in said structure and arranged to be actuated to operate said drive of the toy to let it move when said accessory toy is mounted and fixed in position on said structure.

6 Claims, 5 Drawing Figures

STARTER DEVICE FOR TOYS

This invention relates to a starter device designed for use in a toy which is put in motion by a drive using clockwork or motor as power source.

Generally, for controlling starting and stopping motion of toys, there are employed, in motorized toys, a switch means adapted to turn on and off the electric circuit of the motor and, in clockwork toys, a stopper means designed to directly control the driving mechanism by means of a manual control lever. These known means are operated by mere finger work of an operator either by pushing a switch or by turning a lever, so that such toys, because of simplicity of operation, have little amusingness and lack actuality.

The object of the present invention is to provide a starter device which can be adapted in various types of movable toys such as toy automobiles and whereby starting and stoppage of the toy is effected not directly by simple fingerwork of an operator but indirectly either by mounting and fixing in position an auxiliary toy such as a doll on a principal toy (such as toy automobile) equipped with drive means or by detaching the auxiliary toy from the principal toy.

More specifically, the invention is intended to provide a starter device in which the operating members controlling the drive of the principal toy with mounting and demounting of the auxiliary toy are constructed to form a single unit assembly including a structure for setting the accessory toy in operative relation with the principal toy, thus allowing easy incorporation of the device in the toy.

In order to accomplish the above-said object, the starter device according to the present invention is provided with a cylindrical structure whereby an auxiliary toy such as for example a doll can be detachably set, as by fitting or other means, in the principal toy equipped with a drive using clockwork or electric motor as power source. In said cylindrical structure are also disposed the spring-loaded operating members such as turn lever and stop lever having an operating element actuated upon setting of said auxiliary toy in place on said structure. The end of said stop lever is operatively associated with said drive to control starting and stoppage thereof. The operating members comprising said operating element, turn lever and stop lever may, in some applications, be arranged such that the drive is controlled only by the operating element which is actuated upon mounting of the auxiliary toy. Direct control by such operating element is preferably employed in a drive powered by an electric motor. For example, said operating element may be adapted to control the on-off switch for the electric circuit of the motor.

For better understanding of the mechanical arrangement of the present invention, a preferred embodiment of the invention is described in detail hereinbelow while having reference to the accompanying drawings, in which.

Figure 1:
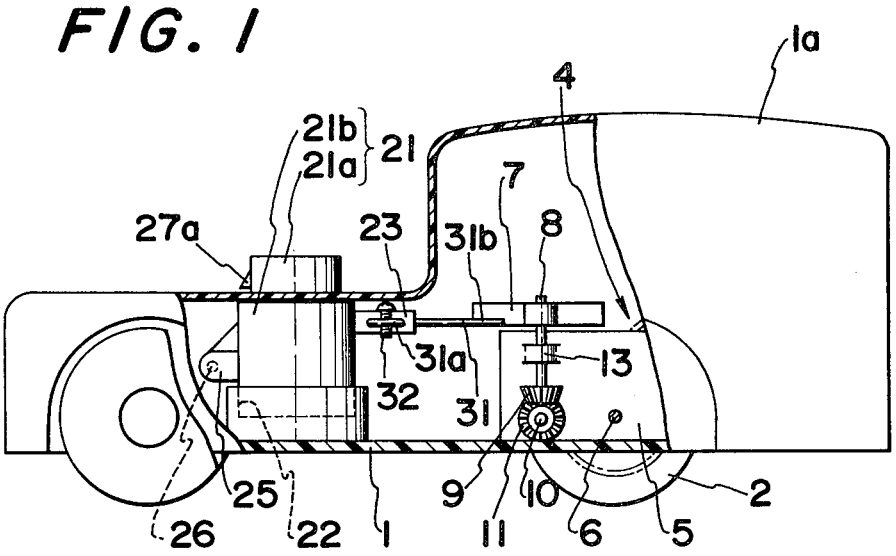
FIG. 1 is a side view of the starter device according to the present invention as it was adapted in a toy automobile, with a part of the shell of the toy being broken away to show the internal arrangement of the parts.
Figure 2:
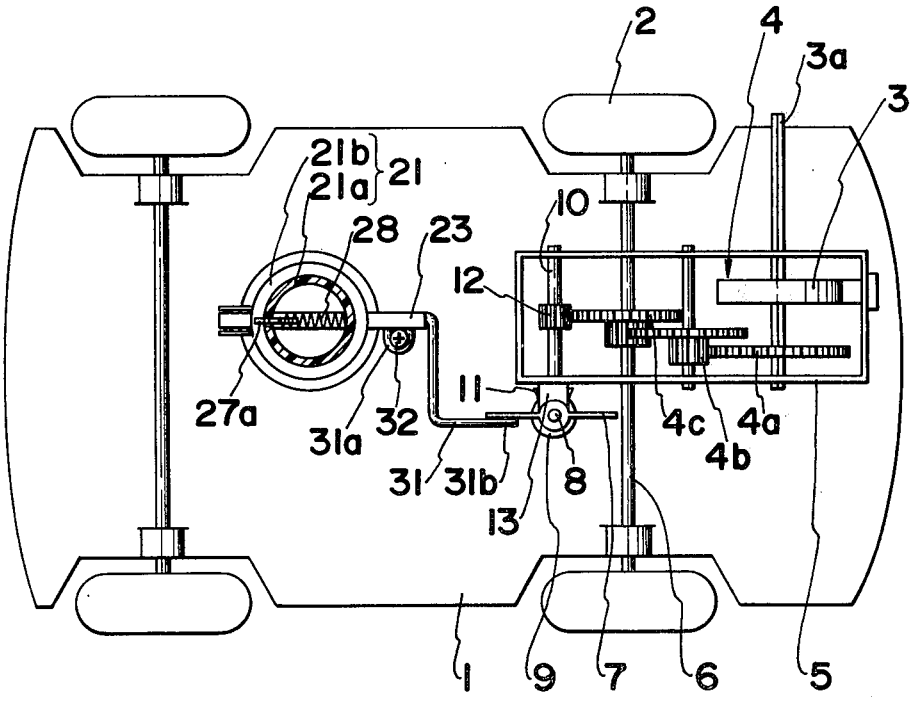
FIG. 2 is a plane view of the toy automobile with its shell being removed and with the accessory toy mounting structure being shown cut horizontally along a section.
Figure 3:
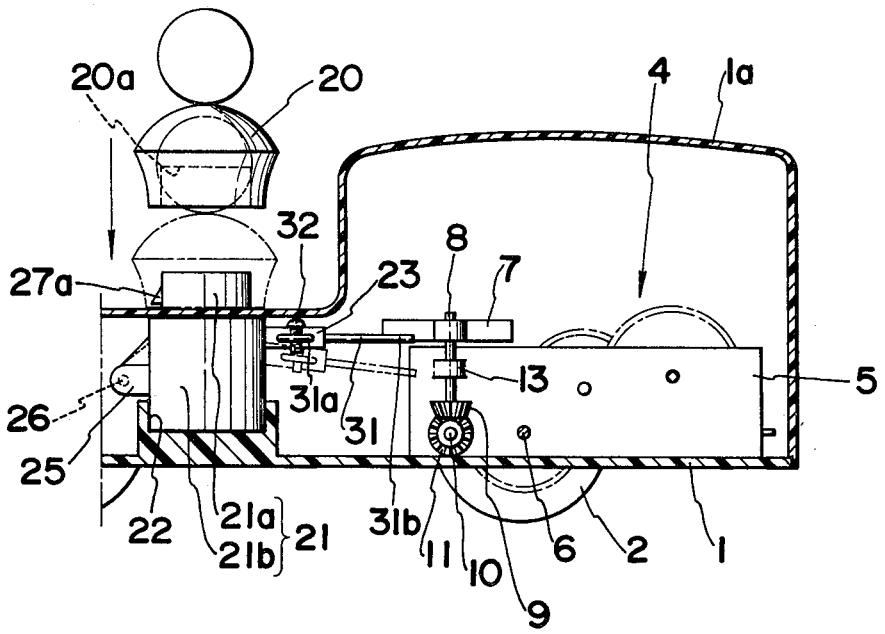
FIG. 3 is a partial side view, with parts cut away, of the toy automobile adapted with the starter device of the present invention whereby the drive of the toy is controlled by the accessory toy.

In FIGS. 1 to 3, numeral 1 designates a plastic-made toy body and 1a the shell or cover thereof. Although the toy body 1 is shown in the drawings as the chassis of a toy automobile, it is of course merely one embodiment of the invention. Mounted on said toy body 1 through a frame 5 is a drive unit, generally designated by numeral 4, using a spiral power spring 3 as power source for driving the wheels 2. Numeral 6 indicates an axle which carries wheels 2 at its both ends. The axle 6 is given the rotative force from the unwinding power spring 3 on a winding shaft 3a through a series of gears 4*a*, 4*b*, 4*c* which are meshed successively in that order, so as to turn the wheels 2 to accordingly move the toy. Connected operatively to said drive unit 4 is a bladelike or otherwise similarly configured rotary element 7 adapted to engage or disengage with the operating members for controlling starting and stoppage of the drive unit as described later. The upper end of said rotary element 7 is secured to an end of a shaft 8 which carries at its other end a bevel gear 9 which is meshed with another bevel gear 11 fixed to a shaft 10 on the side of the drive unit 4. Also mounted on said shaft 10 is a pinion 12 which is meshed with the gear 4*c*. At a side of the frame 5 is provided a bracket 13 adapted to serve as bearing of said shaft 8.

Figure 4:
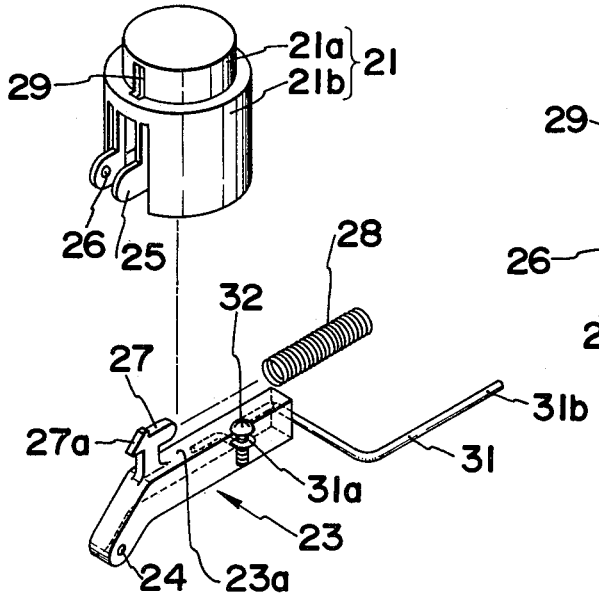
FIG. 4 is an exploded perspective view of the accessory toy mounting structure and its fittings.
Figure 5:
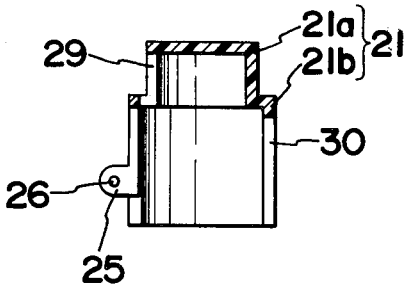
FIG. 5 is a vertical sectional view of the accessory toy mounting structure shown in FIG. 4.

Now the behavior of the operating members controlling starting and stoppage of the drive unit 4 through engagement and disengagement with said rotary element 7 is discussed. Provided on the toy body 1 is an auxiliary toy mounting structure 21 formed separately from said toy body 1 and designed such that an auxiliary toy 20 such as for example a doll can be detachably mounted thereon. This mounting structure 21, as best shown in FIGS. 4 and 5, is in the form of a hollow cylinder consisting of a small-diameter cylindrical portion 21*a* and a large-diameter cylindrical portion 21*b* and generally made of plastic. As shown in FIGS. 1 and 3, the small-diameter cylindrical portion 21*a* projects above the shell 1a so that a recess 20*a* formed at the bottom of the auxiliary toy 20 can snugly fit thereover. The large-diameter cylindrical portion 21*b* elastically fits in a recess 22 formed in the toy body 1. Numeral 23 refers to a rocker arm of which the middle portion is placed in the large-diameter cylindrical portion 21*b*. At both sides of one end of said rocker arm are formed small holes 24 in which fit the corresponding small protuberances 26 provided on a pair of support bars 25 formed by cutting a part of said large-diameter cylindrical portion 21*b*, whereby the rocker arm 23 is rockably supported by said cylindrical portion 21*b* with one end of said arm being held between said support bars 25. Numeral 27 indicates an arrowhead-like working element which projects upwardly from an upper end 23*a* of the rocker arm 23, and a coil spring 28 is disposed between said element 27 and the inner wall of said small-diameter cylindrical portion 21*a* so that the beveled end 27*a* of said element normally stays projecting out from an opening 29 formed in the side wall of said cylindrical portion 21*a*. The free end portion of said rocker arm 23 extends outwardly from a cutout 30 in the large-diameter cylindrical portion 21*b*, and the proximal end 31*a* of a stop lever 31 is secured to said free end portion of the rocker arm 23. Said stop lever 31 is generally shaped like a crank, with the distal end 31 *b* thereof being positioned within the passage of or range of rotation of said rotary element 7 so that when the device is inoperative, said end 31*b* of the stop lever abuts against the rotary element 7 to keep the drive unit 4 at a halt. As shown in FIG. 4, the proximal end portion of the stop lever 31 is in contact with one side of the rocker arm 23, and a U-shaped part of said end portion is passed through to the opposite side of the rocker arm 23, with a screw 32 being securely fixed through said U-shaped part to secure the end portion of the lever 31 to the rocker arm 23. Such securing may of course be attained by using other means. Employment of the securing means allowing detachment of the stop lever from the rocker arm 23 as in the shown embodiment provides a wider versatility of the device as such means permits replacement of the stop lever in accordance with the configuration of the toy adapted with the present starter device or the mounting position of the drive unit. It is also possible to dispense with the stop lever 31 while, instead, extending the free end side of the rocker arm having the working element 27 so that the end thereof is positioned directly within the circle of rotation of the rotary element 7.

Now the operation of the starter device of the present invention is discussed.

First, the power spring 3 in the drive 4 is wound up by a known means to build up motive power so that the toy 1 can be moved at any time. In the stage where the power spring 3 has been wound up to store motive power, the end 31*b* of the stop lever 31 stays in contact with the rotary element 7 so that the drive 4 is kept inoperative and hence the toy 1 can not start moving. For allowing the toy to start moving, an auxiliary toy 20 is fitted on the cylindrical portion 21*a* that constitutes a part of the mounting structure 21 as shown in FIG. 3, whereby the bevelled end 27*a* of the operating element 27 is retracted into the hole 29 against the force of the coil spring 28, thus allowing the rocker arm 23 to make rocking motion. Accordingly, the end 31*b* of the stop lever 31 is urged to move downwardly to displace out of the range of rotation of the rotary element 7 as shown by the phantom line in FIG. 3. As the rotary element 7 is thus freed, the drive 4 is now operated to start movement of the toy 1. If the auxiliary toy 20 is removed from the cylindrical portion 21*a* constituting a part of the mounting structure 21, the end 31*a* of the stop lever 31 is again returned back into the passage of the rotary element 7 through the rocker arm 23 by the action of the coil spring 28 to stop operation of the drive 4. The operating element 27 again projects out from the cutout 29 in the cylindrical portion 21*a*.

While the invention has been described by way of an embodiment using a spring-powered drive, it is possible to use an electric motor as power source. In the latter case, an on-off switch for the electric circuit of the motor is provided in operative connection to the operating element 27. It is further possible to mount an automatic music device or the like, such as a music box, on the toy 1 while utilizing its power source (spring or motor) for operation of the drive of the toy.

As described above, the present invention provides a very entertaining and joyful toy of which the starting and stopping motion is controlled by mounting and demounting of an auxiliary toy. Also, since the operating members such as turn lever 23 and operating element 27 actuated by such auxiliary toy are assembled into a unitary and compact hollow cylindrical structure 21 set in a limited space in the toy 1, the entire device can be easily incorporated in the toy 1.

What is claimed is:

1. A toy comprising:

a. a body;

b. a shaft mounted on said body;

c. a wheel mounted on said body and operatively connected to said shaft for joint rotation;

d. drive means mounted on said body and connected to said shaft for rotating the shaft;

e. a mounting member on said body defining a path for an auxiliary toy toward and away from a mounting position on said body;

f. an operating element movably secured to said mounting member;

g. biasing means yieldably biasing said element toward a position in which a portion of said element extends into said path for displacement of said element by said auxiliary toy during movement of said toy in said path toward said position; and h. stop means movably mounted on said body and operatively interposed between said element and said shaft for stopping said shaft in response to displacement of said engagement portion.

2. A toy as set forth in claim 1, wherein said body is a vehicle body.

3. A toy as set forth in claim 1, said stop means comprising an engagement member radially projecting from said shaft for movement in a circular path when said shaft rotates, and a stop member moving into said path when said operating element is engaged by said auxiliary toy.

4. A toy as set forth in claim 3, wherein said drive means is spring-operated.

5. A toy as set forth in claim 3, wherein said mounting member is hollow said operating element being pivotally mounted in said mounting member and projecting therefrom into said path.

6. A toy as set forth in claim 5, wherein said mounting member has a cylindrical wall formed with an opening, said operating element projecting from said opening.

* * * * *